US008100224B1

(12) United States Patent
Olson

(10) Patent No.: US 8,100,224 B1
(45) Date of Patent: Jan. 24, 2012

(54) SUPPRESSOR WITH POLY-CONICAL BAFFLES

(75) Inventor: Douglas D Olson, Huntsville, AR (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

(21) Appl. No.: 12/972,409

(22) Filed: Dec. 17, 2010

(51) Int. Cl.
*F41A 21/00* (2006.01)

(52) U.S. Cl. ..... 181/223; 181/267; 181/270; 181/212; 89/14.4

(58) Field of Classification Search ..... 181/121, 181/247, 264, 223, 270; 89/14.4
See application file for complete search history.

(56) References Cited

U.S. PATENT DOCUMENTS

| | | | | |
|---|---|---|---|---|
| 4,576,083 | A * | 3/1986 | Seberger, Jr. | 89/14.4 |
| 4,588,043 | A * | 5/1986 | Finn | 181/223 |
| 5,029,512 | A * | 7/1991 | Latka | 89/14.4 |
| 6,575,074 | B1 * | 6/2003 | Gaddini | 89/14.4 |
| 7,237,467 | B1 * | 7/2007 | Melton | 89/14.4 |
| 7,308,967 | B1 * | 12/2007 | Hoel | 181/223 |
| 7,836,809 | B2 * | 11/2010 | Noveske | 89/14.4 |
| 7,987,944 | B1 | 8/2011 | Brittingham et al. | |

* cited by examiner

*Primary Examiner* — Forrest M Phillips
(74) *Attorney, Agent, or Firm* — Haynes and Boone, LLP

(57) ABSTRACT

A firearm suppressor includes at least one baffle disposed within a cylindrical housing. The baffle includes a distal-facing conical baffle having a wider end and an opposing narrower end; and a proximal-facing conical baffle intersected by the distal-facing conical baffle such that the narrower end of the distal-facing conical baffle extends beyond a wider end of the proximal-facing baffle, wherein a central bore extends through both the distal-facing conical baffle and the proximal-facing conical baffle.

22 Claims, 12 Drawing Sheets

SUPPRESSOR WITH POLY-CONICAL BAFFLES

TECHNICAL FIELD

This application relates to firearms, and more particularly to a firearm sound suppressor.

BACKGROUND

Firearm suppressors conventionally include a plurality of baffles contained within a cylindrical housing that attaches to the distal end of the gun barrel. The baffles function to reduce the pressure and velocity of propellant gases so as to suppress gun muzzle blasts. An industry-standard baffle is known as a "K" baffle and has been in widespread use since the 1980's. As seen in FIG. 1, a K baffle 100 includes a flat disc-shaped baffle 105 connected to a distally-facing cone 110 such that a cross-sectional view (not illustrated) of baffle 100 is K-shaped. To slow and deflect the propellant gases produced from a fired cartridge, the bore of baffle 100 has slanted sidewalls 115. Propellant gas is thus deflected away from traveling down the bore of cone 110 and behind baffle 105 instead. In this fashion, the gun muzzle blast is effectively muzzled as the explosive pressure wave from an unsuppressed gun blast is transformed into a lower pressure wave of a greater duration.

Although K baffles have proven to be quite popular, a number of problems remain unresolved. For example, a K baffle uses a substantial amount of metal and thus makes the resulting suppressor relatively heavy. In addition, the disc-shaped baffle 105 must seal against the cylindrical housing that contains the baffles such that baffle 105 is aligned orthogonally with respect to the longitudinal axis of the cylindrical housing. This alignment is difficult to maintain properly during manufacture and is adversely affected by gun blast pressures.

Accordingly, there is a need in the art for suppressor baffles that are self-centering and offer reduced weight while improving the gun muzzle blast suppression of conventional K-shaped baffles.

SUMMARY

In accordance with a first embodiment of the invention, a poly-conical gun suppressor baffle is provided that includes: a forward-facing conical baffle; an opposing rear-facing conical baffle, the forward-facing baffle extending through the rear-facing baffle such that the rear-facing baffle forms a collar around the forward-facing baffle; and a truncated rear-facing conical baffle having an apex adjoining an apex for the forward-facing conical baffle, wherein a central bore having slanted sidewalls extends through the truncated rear-facing conical baffle.

In accordance with a second embodiment of the invention, a firearm suppressor is provided that includes: a cylindrical housing; and a plurality of poly-conical baffles contained within the cylindrical housing, each poly-conical baffle including a forward-facing conical baffle, an opposing rear-facing conical baffle that forms a collar around a mid-section of the forward-facing conical baffle, and a truncated rear-facing conical baffle having an apex adjoining an apex for the forward-facing conical baffle, wherein a central bore having slanted sidewalls extends through each truncated rear-facing conical baffle.

In accordance with a third embodiment of the invention, an interlocking poly-conical gun suppressor baffle is provided that includes: a forward-facing conical baffle extending from an apex to a base; a spacer extending from the base of the forward-facing conical baffle; and an opposing rear-facing conical baffle forming a collar around the forward-facing conical baffle, wherein the spacer includes a cut out adapted to slidably engage an opposing rear-facing conical baffle for another interlocking poly-conical baffle.

In accordance with a fourth embodiment of the invention, a firearm suppressor is provided that includes: a housing; and a plurality of slidably engaged interlocking poly-conical baffles contained within the housing.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE FIGURES

Embodiments of the present invention and their advantages are best understood by referring to the detailed description that follows. It should be appreciated that like reference numerals are used to identify like elements illustrated in one or more of the figures.

DETAILED DESCRIPTION

A poly-conical baffle is provided that is self-centering through the interaction of a forward-facing conical baffle and a rear-facing conical baffle. As these conical baffles are longitudinally loaded within a cylindrical gun suppressor housing, they naturally flex towards each other due to their opposite alignments. Such flexing causes the base of each conical baffle to wedge against the inner diameter of the gun suppressor housing. In this fashion, each poly-conical baffle is self-centering within the gun suppressor housing and maintains its alignment in the face of propellant gas pressures. Indeed, propellant gas pressures aid the conical baffles in flexing against one another to further wedge the baffles against the gun suppressor housing.

In another embodiment, the baffles are modified such that successive poly-conical baffles removably interlock with each other. The self-centering embodiment will be described first followed by a description of the interlocking embodiment.

Figure 2:
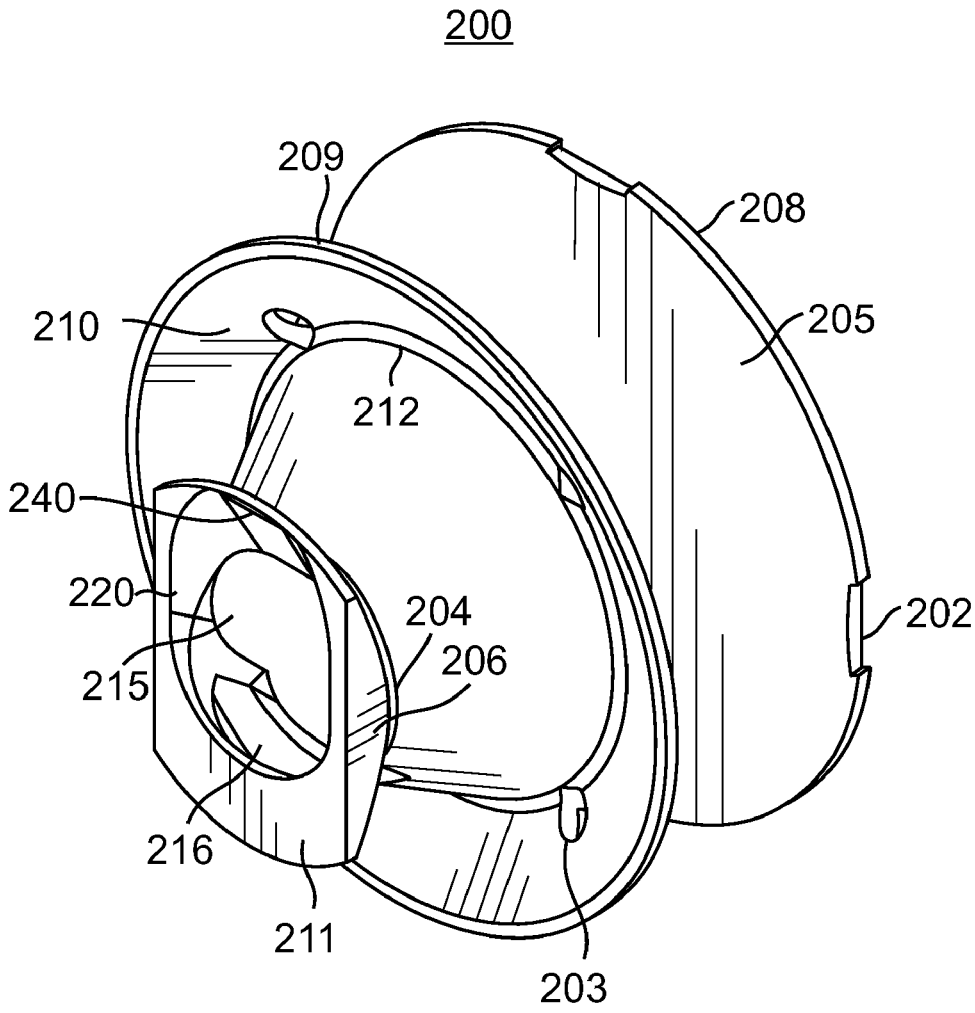
FIG. 2 is a perspective view of a proximal end of a poly-conical baffle.
Figure 3:
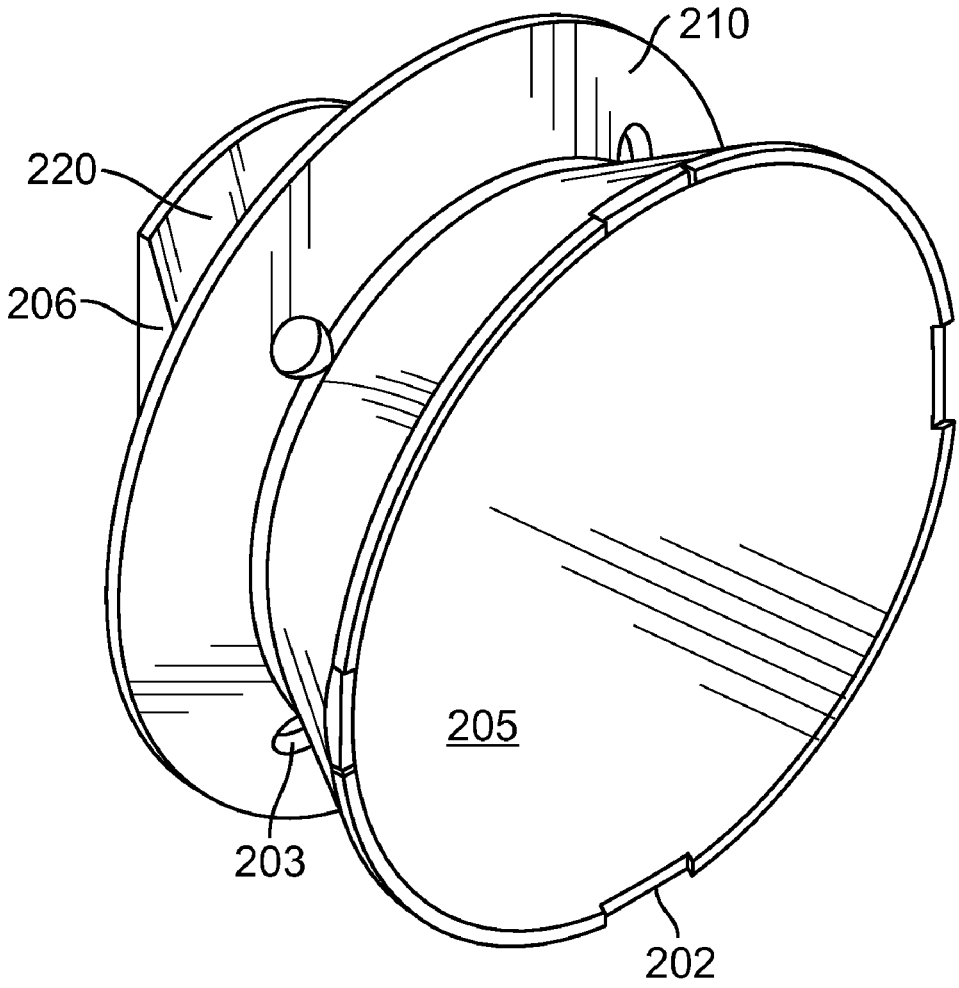
FIG. 3 is a perspective view of a distal end of the poly-conical baffle of FIG. 2.

Turning now to the drawings, an example poly-conical baffle 200 is shown in FIGS. 2 and 3. A forward-facing conical baffle 205 extends from an apex 204 towards a base 208. As used herein, an "apex" for a conical baffle refers to the narrower end whereas a "base" refers to the wider end of each conical baffle. Conical baffle 205 is denoted to be forward facing because the base distally faces away from the gun or firearm barrel. In contrast, a rear-facing conical baffle 210 proximally extends from an apex 212 to a base 209 such that base 209 faces the gun barrel. Because forward-facing baffle 205 extends through apex 212 and base 209 of baffle 210, baffle 210 forms a cylindrical collar around baffle 205. Bases 208 and 209 each have a circumference sized to match the inner circumference of a cylindrical housing (discussed below with regard to FIG. 5) for the resulting suppressor. Apex 204 of baffle 205 includes a central bore 215. Central bore 215 also extends through a truncated rear-facing conical baffle 220 that shares apex 204 for baffle 205. A flattened face 211 forms a base for baffle 220.

Figure 4:
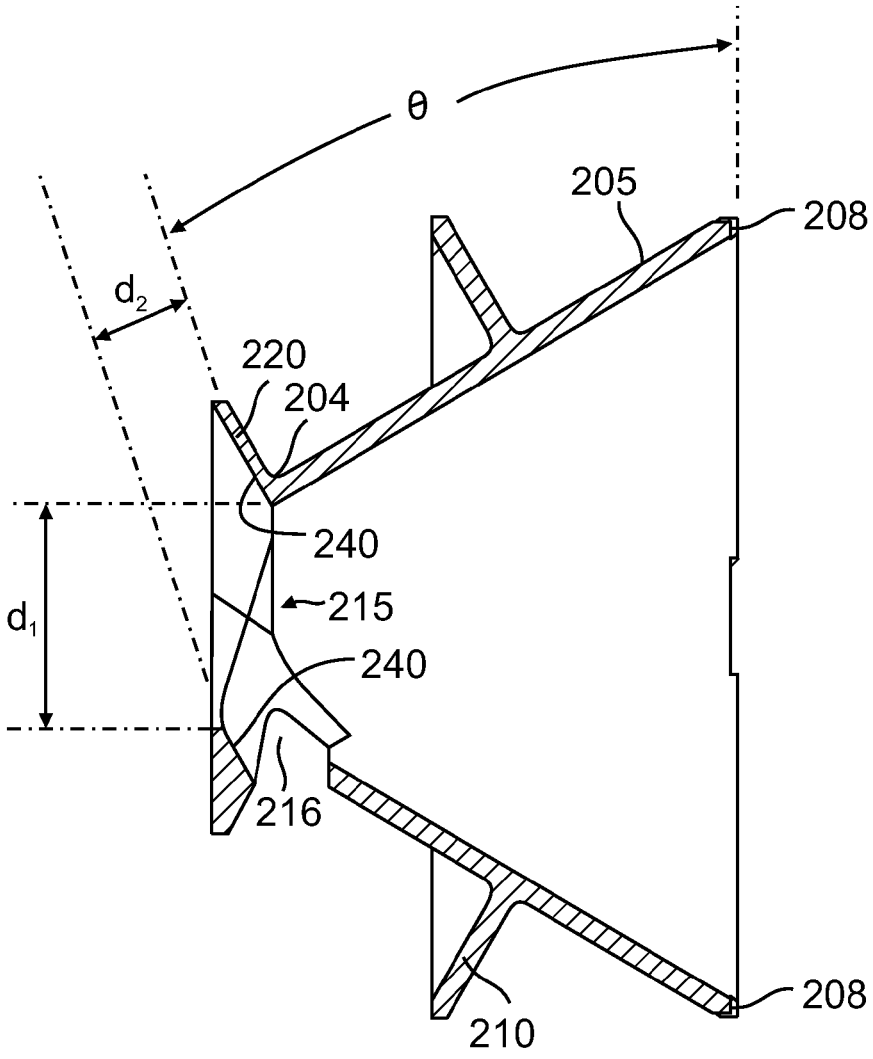
FIG. 4 is a cross-sectional view of the poly-conical baffle of FIG. 2.

As seen in the cross-sectional view of FIG. 4, central bore 215 has a diameter $d_1$ through apex 204 of both truncated baffle 220 and forward-facing baffle 205. This diameter must of course be sufficient as determined by the gun caliber to allow the corresponding bullet to pass unhampered through the baffles. Truncated conical baffle 220 has slanted sidewalls 240 that direct propellant gases to a port 216 through apex 204. For example, a first end mill corresponding to diameter $d_1$ may form bore 215. This first milling is performed along the longitudinal axis that is orthogonal to a vertical plane defined by base 208 of forward-facing frustum baffle 205. A second end mill oriented at a relatively shallow angle θ such as 30° to the vertical plane and corresponding to a smaller-than-$d_1$ diameter $d_2$ may form slanted sidewalls 240. For example, in a 9 mm embodiment, diameter $d_1$ may be 0.390 inch whereas diameter $d_2$ may be 0.250 inch.

Figure 1:
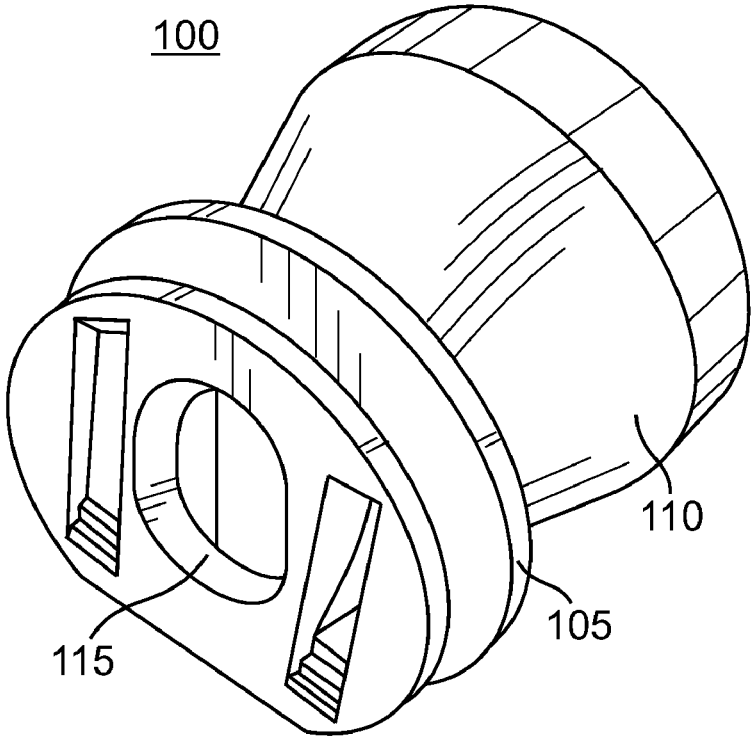
FIG. 1 is a perspective view of a conventional K-shaped baffle.

Referring back to FIG. 1, conventional K baffle 100 also has slanted sidewalls for the central bore. It can be seen, however, that the slant for such sidewalls is typically around 45 degrees. Keeping angle θ for truncated conical baffle 220 at a relatively shallow angle such as 30 degrees substantially reduces a necessary length for truncated baffle 220 to thereby reduce the corresponding weight for resulting conical baffle 200. Referring again to FIG. 2, a width for flat face 211 for truncated conical baffle 220 is less than a width for bases 208 and 209, which also reduces the mass for complete baffle 200. For example, a width for flat face 211 may be approximately one-half that for bases 208 and 209 (and hence approximately one-half of the inner diameter for a corresponding cylindrical housing as discussed further with regard to FIG. 5). Baffle 220 is partially removed on its sides to form flat surfaces 206 to help funnel propellant gases across central bore 215 and thus further slow the passage of gas through the resulting suppressor.

Slanted sidewalls 240 direct propellant gases through port 216 and against the collar formed by baffle 210. Thus, the bulk of gases vented through port 216 must circulate around baffle 220 to re-enter central bore 215. Moreover, because flat face 211 of baffle 220 has a relatively small width as compared to bases 208 and 209, a considerable portion of the propellant gases bypass central bore 215 initially and instead are directed directly against baffle 210. This delays the passage of gas from behind baffle 220 and creates greater sound suppression than offered by conventional K baffle 100. To prevent excessive pressure building up behind baffle 210, several relief passages 203 may be provided in baffle 210. Similarly, forward-facing conical baffle 205 includes a plurality of slot-shaped vents 202. It is desirable for a suppressor to not only suppress the gun blast but also the associated flame. Thus, slot-shaped vents 202 have a depth of less than 0.016 inch in one embodiment to prevent flame from passing through them.

Figure 5:
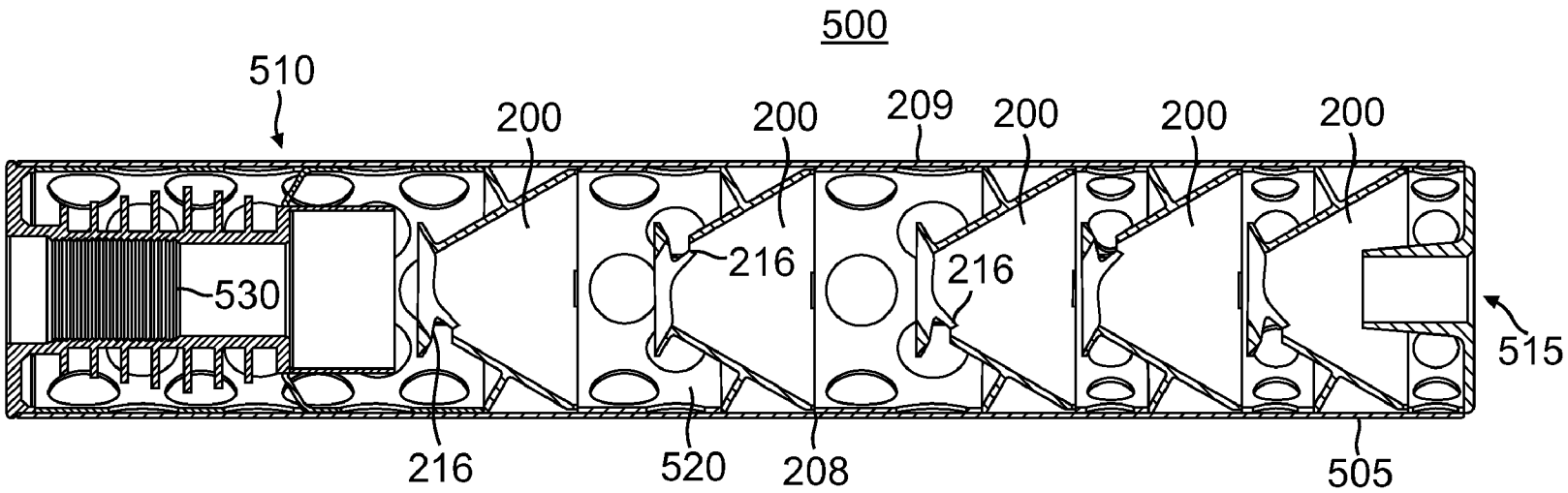
FIG. 5 is cross-sectional view of a suppressor including a plurality of poly-conical baffles spaced apart by spacers.

Referring now to FIG. 5, a suppressor 500 includes a plurality of poly-conical baffles 200. In this embodiment, there are a total of five poly-conical baffles 200 but it will be appreciated that the total number of poly-conical baffles 200 is a design choice and involves a tradeoff between increased sound suppression (more baffles) versus lower weight (less baffles). A cylindrical housing 505 has an inner diameter that substantially matches a diameter for bases 208 and 209 discussed with regard to FIGS. 2 and 3. To aid in the delay of propellant gases through suppressor 500, vents 216 may be oriented at 180 degrees with respect to neighboring baffles 200. Thus, a first vent may be deemed as directed "downwards", an adjacent vent may be deemed as directed "upwards," and so on. A rear or proximal cap 510 and a front or distal cap 515 seal baffles 200 within housing 505. Rear cap 510 includes threads 530 or other means to allow a user to secure suppressor 500 to a corresponding gun barrel. Perforated annular spacers 520 abut against poly-conical baffles 200 and the end caps 510 and 515 to position each baffle as desired (depending upon the length of each adjacent spacer) within housing 505. For each poly-conical baffle 200, a proximal spacer 520 abuts against base 209 whereas a distal spacer 520 abuts against base 208. During assembly, the stacked spacers 520 and poly-conical baffles 200 may be longitudinally compressed within housing 505 to ensure that the baffles self-center within the housing. Caps 510 and 515 may then be welded or otherwise secured to housing 505 to permanently seal suppressor 500. In an alternative embodiment, end caps 510 and 515 could threadably engage housing 505. However, housing 505 would then require greater thickness to accommodate the threads, which adds to bulk and thus requires a reduction of the baffle size and suppression efficiency accordingly. All components for suppressor 500 may be constructed from titanium for strength and weight savings. Alternatively, other metals or composite materials may be used to construct suppressor 500.

Regardless of what material is used to construct suppressor 500, it may immediately be appreciated that the resulting construction is lighter than a suppressor having a corresponding number of K baffles of the same material. Despite being lighter, suppressor 500 offers better gun blast suppression as compared to a K-baffle-containing suppressor.

Figure 6A:
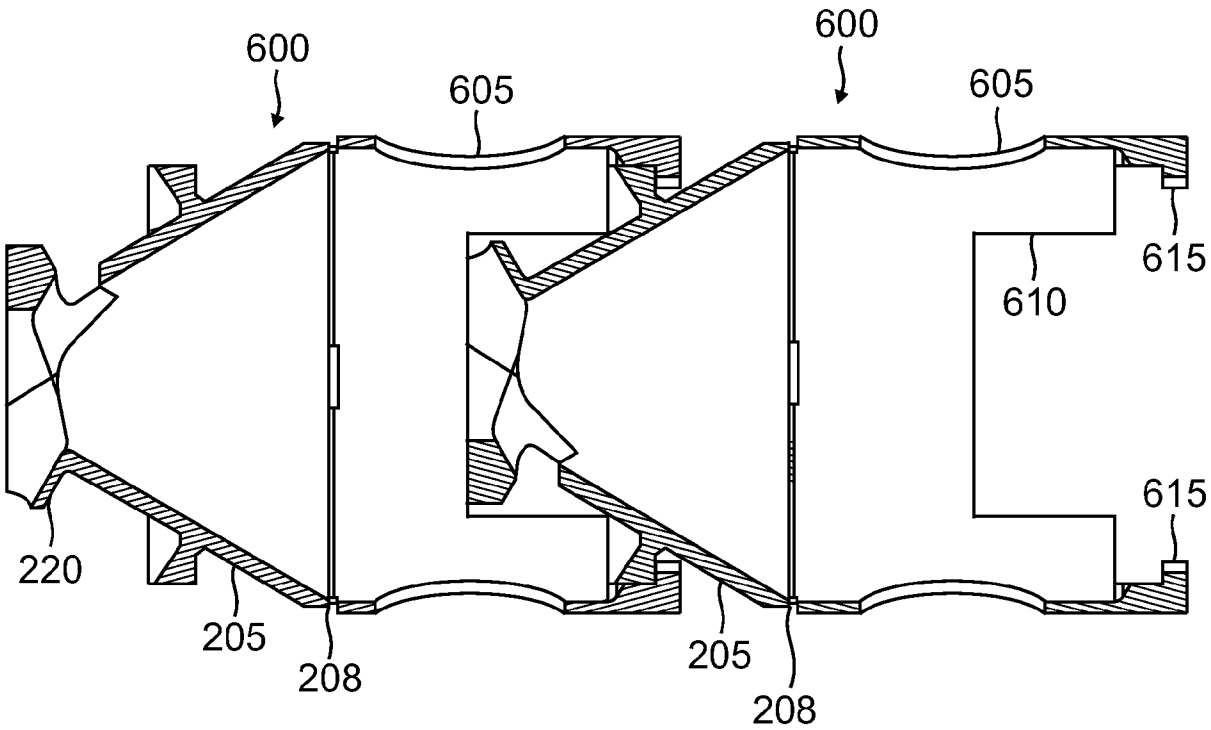
FIG. 6*a* is a cross-sectional view of a pair of interlocked poly-conical baffles.
Figure 6B:
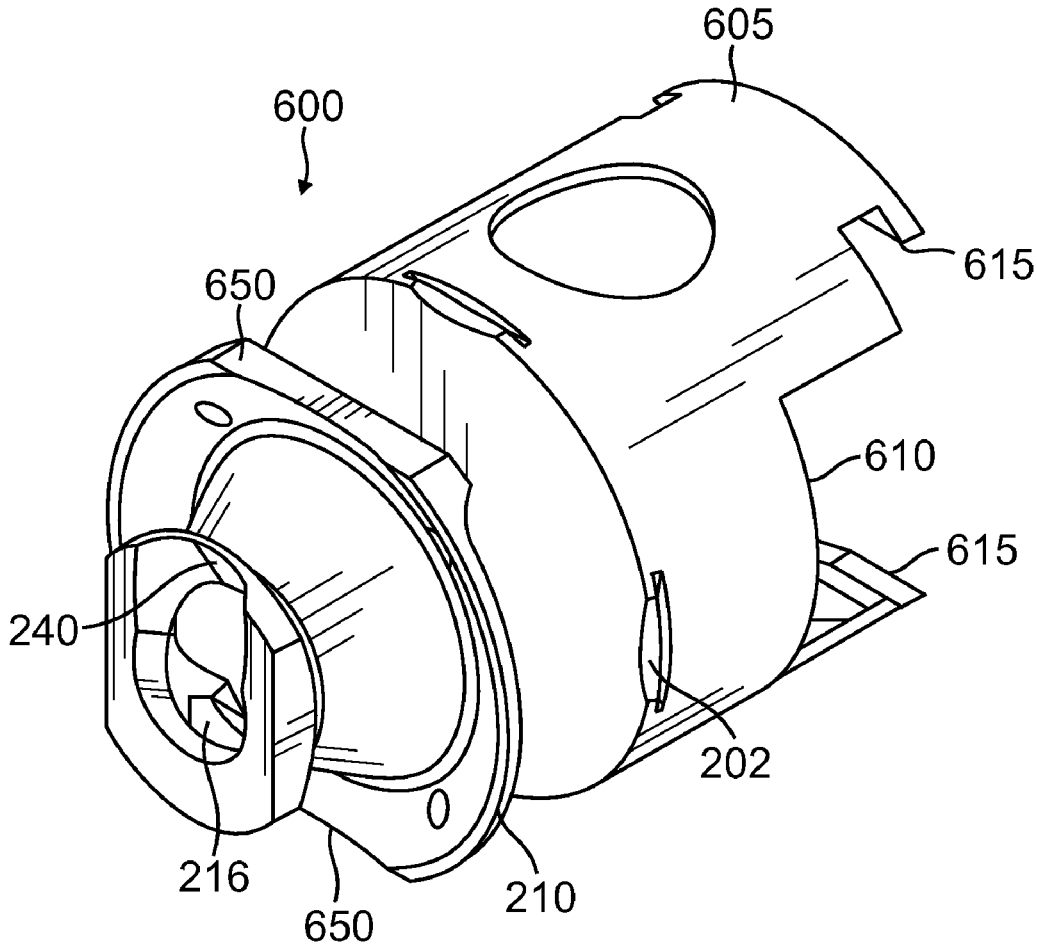
FIG. 6*b* is a perspective view of the proximal end for one of the interlocking poly-conical baffles of FIG. 6*a*.

Although welding avoids having to introduce threads into the cylindrical housing, it prevents a user from taking the resulting permanently-assembled suppressor apart for cleaning and maintenance. To provide an ability to dissemble the resulting suppressor, two interlocking poly-conical baffles 600 are shown in FIG. **6*a* that are integral with their spacers 605. Base 208 of forward-facing conical baffle 205 thus attaches to a proximal end of spacer 605. The interlocking nature of these poly-conical baffles advantageously provides for a readily assembled and disassembled suppressor as will be discussed further herein. Each spacer 605 includes a cutout 610 to receive the rear facing conical baffle 210 discussed previously. Baffle 210** is thus modified to mate with cutout 610 as seen in FIG. 6*b*. For example, a distal end of each spacer 605 may include a lip or shelf 615 configured to engage with rear-facing conical baffle 210 of an adjoining poly-conical baffle. Thus, baffle 210 is modified to include flat faces 650 to enable baffle 210 to engage with lip 615. To connect two poly-conical baffles 600, a user would thus merely slide one of the baffles through cutout 610 to engage lip 615 of the remaining baffle. Similarly, the user may then slide them apart for cleaning and maintenance.

As seen in FIG. 6*b*, flat faces 650 may be oriented in the same linear direction as defined by slanted sidewalls 240. Thus, port 216 will be adjacent one of flat faces 650. Such an alignment means that ports 216 are either all aligned in the resulting suppressor or preferably can be 180 degrees out of phase as discussed with regard to FIG. 5. In general, an orientation of ports 216 in an up-down-up-down opposing fashion as discussed above provides significant gun blast suppression in that a portion of the combustion gas flow is thus forced to change direction from baffle to baffle, thereby spreading the resulting pressure wave out over time. Poly-conical baffles 600 can thus be configured such that a user is forced to alternate ports in this fashion. Alternatively, the poly-conical baffles may be constructed symmetrically such that a user may experiment to find the port orientation that provides the greatest suppression. As discussed previously, forward-facing poly-conical baffles 205 may include a plurality of slot-shaped vents 202 to vent pressure building up between baffles 205 and 210. Advantageously, such vents may have a depth of less than 0.016 inch to suppress flame production by the resulting suppressor.

Figure 7:
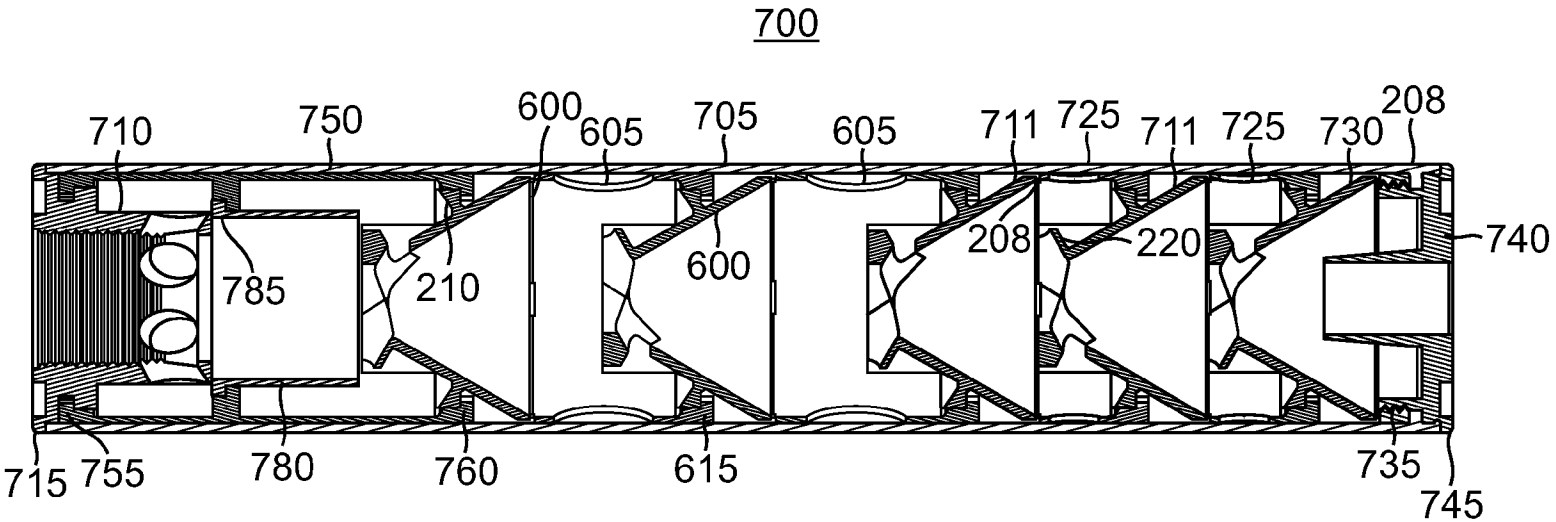
FIG. 7 is a cross-sectional view of a suppressor including a plurality of interlocked poly-conical baffles.

A suppressor 700 including five interlocking poly-conical baffles contained within a cylindrical housing 705 is shown in FIG. 7. Depending upon whether a given poly-conical baffle is distal or proximal within suppressor 700, the spacer length is varied. In that regard, the pressures from the combustion gases are higher in the proximal portions of the suppressor. Thus, a pair of rear-most proximal poly-conical baffles 600 have relatively longer spacer 605 lengths. However, the next two poly-conical baffles 711 in the forward direction have spacers 725 that are relatively shorter. Indeed, spacers 725 have a length such that a base for rear-facing truncated conical baffle 220 of the next poly-conical baffle is virtually flush with the rearward spacer's base 208. A distal-most baffle 730 need not include a spacer but instead has base 208 connect to a threaded collar 735. A front cap 740 threadably engages collar 735 during assembly of suppressor 700 as discussed further herein. A rear-most poly-conical baffle 600 has its baffle 210 engage with a rear spacer 750. Rear spacer 750 thus has a forward cutout analogous to cutout 610 in FIG. 6 to receive the rear-most poly-conical baffle. A rear cutout in spacer 750 receives a read end cap 710. Referring back to FIG. 6, it may be seen that an analogous poly-conical baffle length progression is used in suppressor 500.

Rear end cap 710 includes a collar 715 adapted to engage a proximal or rear end of housing 705. Cap 710 also includes an annular recess shaped to engage with a lip or shelf 755 formed in the rear cutout of spacer 750. Each proximal component thus slidably engages through a cutout in the adjacent distal component. In other words, rear cap 710 engages with lip 755 of rear spacer 750. In turn, rear spacer 750 has a distal lip or shelf 760 that engages with conical baffle 210 for the rear-most poly-conical baffle 600. Each successive poly-conical baffle thus has its conical baffle 210 engage with the collar 615 of the proximal poly-conical baffle.

Figure 8:
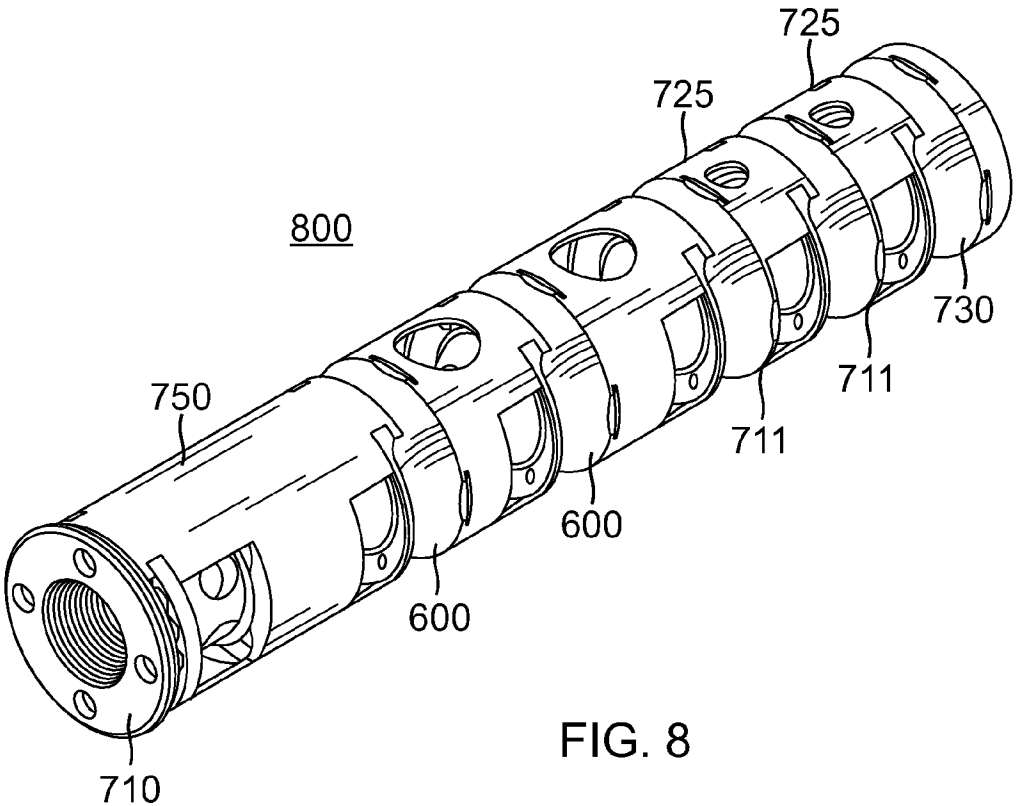
FIG. 8 is a perspective view of a plurality of an interlocked suppressor assembly prior to its insertion into the cylindrical housing.

A user would thus engage and stack components 710, 750, 600, 711, and 730 to form a baffle core assembly 800 as shown in FIG. 8. The resulting suppressor assembly is then inserted into housing 705 until collar 715 abuts against a proximal end face of housing 705. Distal or front end cap 740 may then be threadably engaged with threads 735 on distal-most poly-conical baffle 730 until a collar 745 on front end cap 740 engages a distal end face of housing 705. Housing 705 is thus longitudinally compressed whereas the poly-conical baffles in assembly 800 are longitudinally stretched. Although such a stretching does not exploit the self-centering nature of the opposing conical baffles discussed previously, the integral spacers and the interlocking nature of the poly-conical baffles in assembly 800 keeps them properly aligned.

Figure 9:
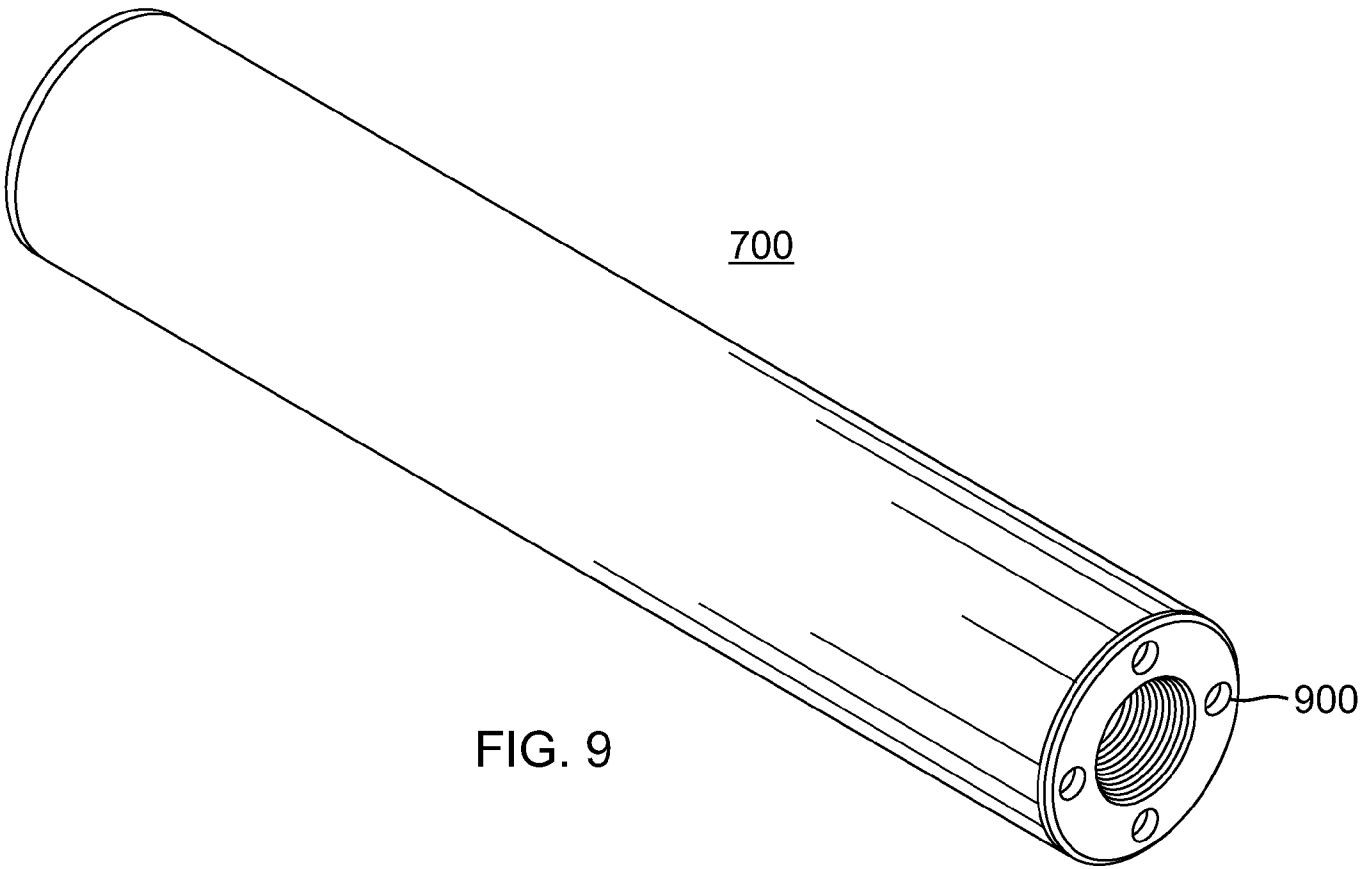
FIG. 9 is a perspective view of the proximal end of the suppressor of FIG. 7.
Figure 10:
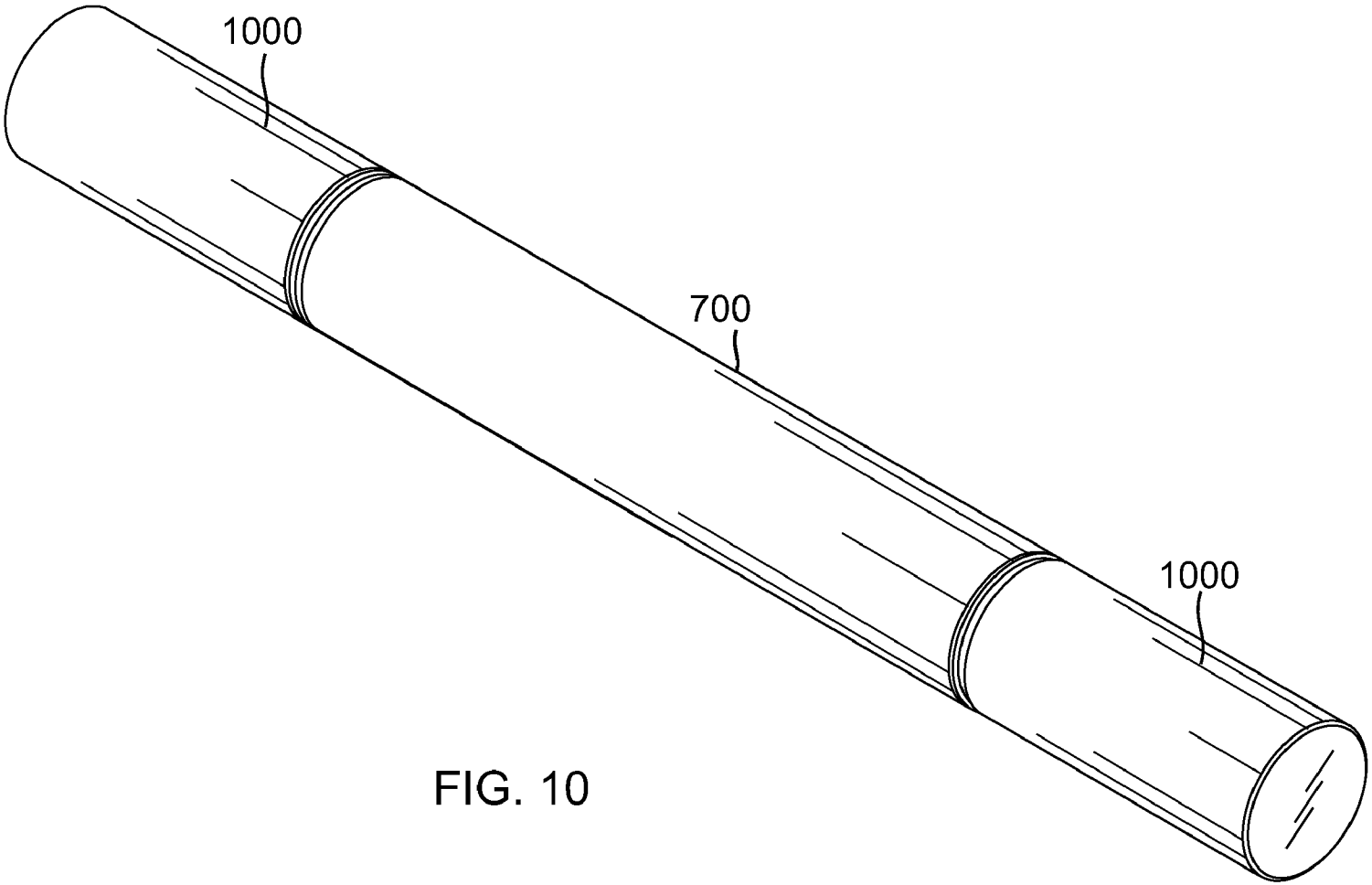
FIG. 10 is a perspective view of the suppressor of FIG. 7 having its end caps engaged by spanner wrenches.

Various means may be used to enable a wrench or spanner to tighten front end cap 740 while securing rear end cap 710 so as to prevent assembly 800 from turning while front end cap 740 is rotated. For example, as seen in FIG. 9, each end cap can include a plurality of spanner cuts 900. A user would thus engage spanner cuts 900 on each end cap with an appropriate spanner wrench 1000 as shown in FIG. 10 to complete assembly of suppressor 700.

Figure 11:
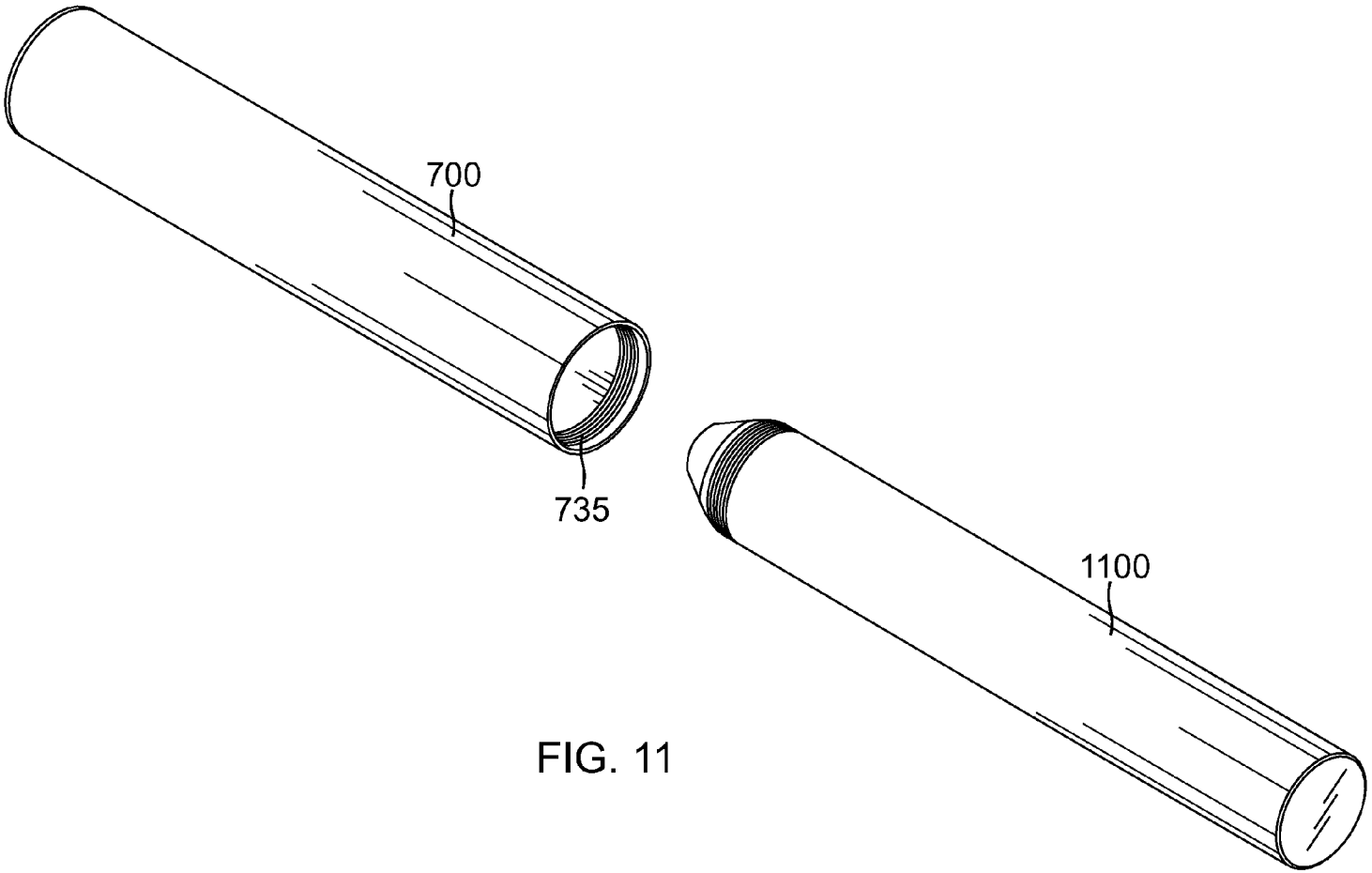
FIG. 11 is a perspective view of the suppressor of FIG. 7 having its distal end cap removed so as to threadably engage with a disassembly tool.

To disassemble the suppressor, the spanner wrenches may be used to remove the end caps. As shown in FIG. 11, a disassembly tool 1100 may then be threaded with threads 735 (FIG. 7) on poly-conical baffle 730. Striking the end of tool 1100 on a hard surface while grasping housing 705 will thus drive assembly 800 out of housing 705, whereupon a user may slide the various components as discussed above to complete disassembly.

End caps 740 and 710 hold housing 705 in compression while interlocked suppressor assembly 800 rests with considerable friction along the inside diameter of housing 705. Thus, the torque to turn housing 705 relative to the remainder of suppressor assembly 800 is high relative to the torque needed to thread on or remove the suppressor from the gun barrel. Such a relationship prevents a user from having the rear plug unthread from the housing (leading to possible dumping of associated components) while a user tries to remove the suppressor from a gun barrel.

Referring again to FIG. 7, rear spacer 750 may be configured to receive an optional cylindrical insert 780. Insert 780 may include a shoulder or collar 785 that engages with spacer 750 and prevents further distal displacement of the insert. Rear end cap 710 abuts insert 780 and thus prevents any proximal displacement of the insert upon assembly of suppressor 700. Such an insert advantageously allows a user to experiment in that although it will generally aid suppression, there may be certain gun calibers and configurations in which a user may wish to leave insert 780 out of the suppressor assembly.

The poly-conical baffles disclosed herein are considerably lighter than comparable K baffles yet offer even greater gun blast suppression. Moreover, the advantageous efficiency of such poly-conical baffles reduces the "first round pop" problem that otherwise reduces the sound suppression prior to the oxygen being exhausted in a suppressor during the course of repeated firings. In addition, the poly-conical baffles are either self-centering or can be modified so as to be interlocking and thus inherently aligned within the suppressor's cylindrical housing.

Embodiments described above illustrate but do not limit the invention. Thus, it should also be understood that numerous modifications and variations are possible in accordance with the principles of the present invention. Accordingly, the scope of the invention is defined only by the following claims.

I claim:

1. A poly-conical firearm suppressor baffle having a distal end and an opposing proximal end, comprising:

a forward-facing conical baffle facing the distal end;

an opposing rear-facing conical baffle facing the proximal end, the forward-facing baffle extending through the rear-facing baffle such that the rear-facing baffle forms a collar around the forward-facing baffle; and a truncated rear-facing conical baffle facing the proximal end and having an apex adjoining an apex for the forward-facing conical baffle, wherein a central bore having slanted sidewalls extends through the truncated rear-facing conical baffle.

2. The poly-conical baffle of claim 1, wherein the truncated rear-facing conical baffle has a flattened face.

3. The poly-conical baffle of claim 1, wherein the truncated rear-facing conical baffle has a port in communication with the slanted sidewalls.

4. The poly-conical baffle of claim 3, wherein the port is adjacent a bottom of the slanted sidewalls.

5. The poly-conical baffle of claim 4, wherein the collar formed by the rear-facing conical baffle and the forward-facing conical baffle each includes a plurality of gas-relief passages.

6. The poly-conical baffle of claim 4, wherein the slanted sidewalls form an angle less than 45 degrees with regard to the flattened face, and wherein the gas-relief passages in the forward-facing conical baffles are slot-shaped with a depth of less than 0.016 inch.

7. The poly-conical baffle of claim 6, wherein the angle is 30 degrees.

8. The poly-conical baffle of claim 1, wherein the baffles comprise titanium.

9. The poly-conical baffle of claim 2, wherein the truncated rear-facing conical baffle is partially removed on its sides.

10. A firearm suppressor having a distal end and an opposing proximal end, comprising a cylindrical housing; and a plurality of poly-conical baffles contained within the cylindrical housing, each poly-conical baffle including a forward-facing conical baffle facing the distal end, an opposing rear-facing conical baffle facing the proximal end, wherein the opposing rear-facing conical baffle forms a collar around a mid-section of the forward-facing conical baffle, and a truncated rear-facing conical baffle facing the proximal end and having an apex adjoining an apex for the forward-facing conical baffle, wherein a central bore having slanted sidewalls extends through each truncated rear-facing conical baffle.

11. The suppressor of claim 10, wherein each truncated rear-facing conical baffle includes a port in communication with the slanted sidewalls.

12. The suppressor of claim 11, further comprising a rear cap and a forward cap for the cylindrical housing.

13. The suppressor of claim 11, wherein the collar formed by rear-facing baffle includes a plurality of gas-relief passages.

14. The suppressor of claim 13, wherein the slanted sidewalls form an angle less than 45 degrees with regard to the flattened face.

15. An interlocking poly-conical firearm suppressor baffle having a distal end and an opposing proximal end, comprising:

a forward-facing conical baffle facing the distal end and extending from an apex to a base;

a spacer extending from the base of the forward-facing conical baffle; and an opposing rear-facing conical baffle facing the proximal end and forming a collar around the forward-facing conical baffle, wherein the spacer includes a cut out adapted to slidably engage an opposing rear-facing conical baffle for another interlocking poly-conical baffle.

16. The suppressor of claim 15, wherein the angle is 30 degrees.

17. The interlocking poly-conical firearm suppressor baffle of claim 15, further comprising:

a truncated rear-facing conical baffle facing the proximal end and having an apex adjoining the apex for the forward-facing conical baffle, wherein a central bore having slanted sidewalls extends through the truncated rear-facing conical baffle.

18. The interlocking poly-conical firearm suppressor baffle of claim 17, wherein the truncated rear-facing conical baffle has a port in communication with the slanted sidewalls.

19. A firearm suppressor, comprising:

A housing; and

A plurality of slidably engaged interlocking poly-conical baffles contained within the housing;

Wherein the firearm suppressor comprises a distal end and an opposing proximal end, wherein at least some of the interlocking poly-conical baffles each comprises:

A forward-facing conical baffles facing the distal end and extending from an apex to a base;

A spacer extending from the base of the forward-facing conical baffles; and

An opposing rear-facing conical baffles facing the proximal end and forming a collar around the forward facing conical baffle, wherein the spacer includes a cutout adapted to slidably engage an opposing rear-facing conical baffle for an adjacent interlocking poly-conical baffle.

20. The firearm suppressor of claim 19, wherein a rearmost one of the interlocking poly-conical baffles slidably engages a rear spacer that in turn slidably engages a rear end cap for the suppressor.

21. The firearm suppressor of claim 20, wherein the rear spacer includes a removable cylindrical insert.

22. The firearm suppressor of claim 20, wherein a forwardmost of the interlocking poly-conical baffles includes threads for threadably engaging a front end cap.

* * * * *